US005893516A

United States Patent [19]

Harcombe et al.

[11] Patent Number: 5,893,516

[45] Date of Patent: Apr. 13, 1999

[54] INJECTOR

[75] Inventors: Anthony Thomas Harcombe, Richmond; Andrew Male, North Acton; Ronald Phillips, Hayes, all of United Kingdom

[73] Assignee: Lucas Industries plc, United Kingdom

[21] Appl. No.: 08/905,444

[22] Filed: Aug. 4, 1997

[30] Foreign Application Priority Data

Aug. 6, 1996 [GB] United Kingdom ..... 9616520
Jan. 14, 1997 [GB] United Kingdom ..... 9700620

[51] Int. Cl.[6] ..... F02M 45/10

[52] U.S. Cl. ..... 239/95; 239/533.8

[58] Field of Search ..... 239/88, 90, 91, 239/93, 94, 95, 533.2, 533.3, 533.8, 533.9, 585.1

[56] References Cited

U.S. PATENT DOCUMENTS 4,759,330 7/1988 Kato et al. ..... 123/446
5,301,875 4/1994 Gant et al. ..... 239/94
5,472,142 12/1995 Iwanaga ..... 239/96

FOREIGN PATENT DOCUMENTS

93/07379 4/1993 WIPO .

*Primary Examiner*—Andres Kashnikow
*Assistant Examiner*—Jorge S. Bocanegra
*Attorney, Agent, or Firm*—Andrus, Sceales, Starke & Sawall

[57] ABSTRACT

An injector comprises a body, a valve needle slidable within the body and biassed into engagement with a seating by a spring, a fuel supply line for supplying fuel to thrust surfaces provided on the valve needle to apply a force on the valve needle acting against the action of the spring, a drain valve operable to control communication between the supply line and a low pressure drain, a needle control valve controlling the fuel pressure within a control chamber defined, in part, by a surface of the valve needle or a component carried thereby oriented such that when high pressure fuel is applied to the control chamber, a force is applied to the valve needle in a direction assisting the spring, wherein the drain valve and the needle control valve are controlled by an electromagnetic actuator arrangement including a single armature, the needle control valve and the surface of the valve needle or component carried thereby defining part of the control chamber being of dimensions such that the needle control valve is substantially pressure balanced at all times.

19 Claims, 5 Drawing Sheets

INJECTOR

BACKGROUND OF THE INVENTION

This invention relates to an injector for use in supplying fuel at high pressure to a cylinder of an associated internal combustion engine, in particular to an injector in which the injection pressure and timing of injection can be controlled independently.

One technique for controlling injection pressure independently of injection timing is to provide an injector arranged to be supplied with fuel by a suitable cam operated pump, which conveniently forms part of the injector, the injector including a first valve arranged to control the flow of fuel to a suitable low pressure drain, and a second valve arranged to control the movement of a valve needle of the injector. It will be appreciated that the second valve controls the timing of the start and end of injection, whilst the injection pressure is controlled by controlling the time at which the first valve closes relative to movement of the second valve; higher injection pressures being achieved by closing the first valve early compared to the timing of commencement of injection. The first and second valves are controlled independently of one another thus the injector and control arrangements for the injector are relatively complex.

SUMMARY OF THE INVENTION

It is an object of the invention to provide an injector capable of permitting independent control of the injection pressure and timing of injection which is of relatively simple form.

According to a first aspect of the invention, there is provided an injector comprising a body, a valve needle slidable within the body and biassed into engagement with a seating by a spring, a fuel supply line for supplying fuel to thrust surfaces provided on the valve needle to apply a force on the valve needle acting against the action of the spring, a drain valve operable to control communication between the supply line and a low pressure drain, a needle control valve controlling the fuel pressure within a control chamber defined, in part, by a surface of the valve needle or a component carried thereby oriented such that when high pressure fuel is applied to the control chamber, a force is applied to the valve needle in a direction assisting the spring, wherein the drain valve and the needle control valve are controlled by an electromagnetic actuator arrangement including a single armature, the needle control valve and the surface of the valve needle or component carried thereby defining part of the control chamber being of dimensions such that the needle control valve is substantially pressure balanced at all times.

The control chamber conveniently communicates through an orifice with a low pressure drain. Alternatively, the control chamber may communicate with the low pressure drain through a clearance.

According to a second aspect of the invention there is provided an injector comprising a body, a valve needle slidable within the body and biassed into engagement with a seating by a spring, a fuel supply line for supplying fuel to thrust surfaces provided on the valve needle to apply a force on the valve needle acting against the action of the spring, a drain valve operable to control communication between the supply line and a low pressure drain, a needle control valve controlling the fuel pressure within a control chamber defined, in part, by a surface of the valve needle or a component carried thereby oriented such that when high pressure fuel is applied to the control chamber, a force is applied to the valve needle in a direction assisting the spring, wherein the drain valve and the needle control valve are controlled by an electromagnetic actuator arrangement including a single armature, the area of the surface of the valve needle or component carried thereby defining part of the control chamber being substantially equal to the area of the thrust surfaces.

According to another aspect of the invention there is provided an injector comprising a body, a valve needle slidable within the body and biased into engagement with a seating by a spring, a fuel supply line for supplying fuel to thrust surfaces provided on the valve needle to apply a force to the valve needle opposing that applied by the spring, a drain valve controlling communication between the supply line and a low pressure drain, a needle control valve controlling the timing of fuel injection, and an actuator including a single armature controlling operation of the drain and needle control valves, wherein movement of the armature to a first position occurs against the action of first and second spring means, such movement closing the drain valve, movement of the armature to a second position occurring against the action of the second means only, such movement closing the needle control valve.

The invention will further be described, by way of example, with reference to the accompanying drawings, in which:

DETAILED DESCRIPTION OF THE PREFERRED EMBODIMENTS

Figure 1:
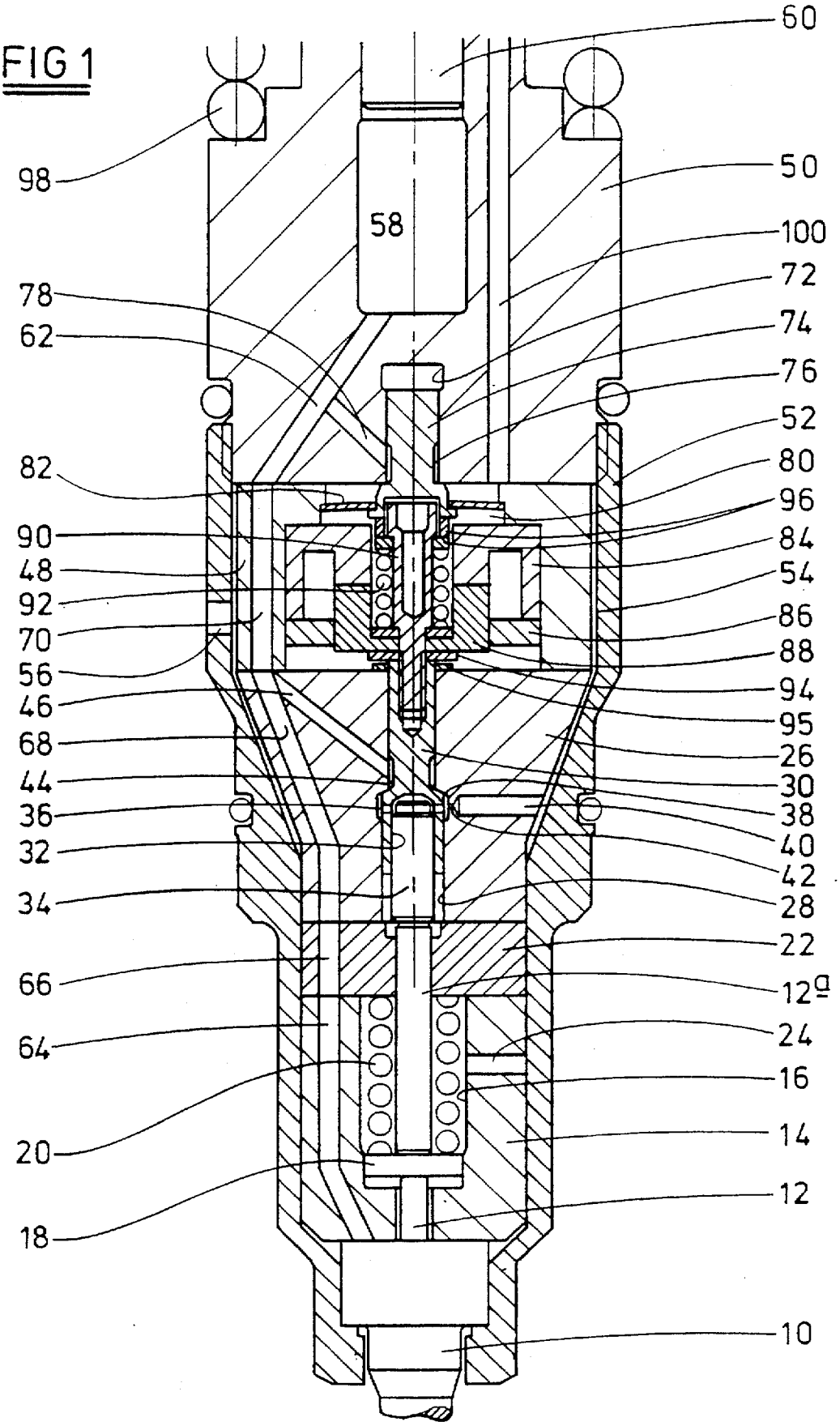
FIG. 1 is a sectional view of part of a pump injector in accordance with an embodiment of the invention.

The injector illustrated in the accompanying drawings comprises a nozzle body 10 (only part of which is illustrated) of conventional form having a valve needle 12 slidable within a bore provided in the nozzle body 10. The valve needle includes angled, thrust surfaces which are oriented so that upon supplying high pressure fuel thereto, the needle tends to lift away from a seating provided in the nozzle body 10 permitting injection of fuel.

A spring housing 14 engages an end of the nozzle body 10, the spring housing including an axially extending through bore through which part of the needle 12 extends. The through bore includes a region of enlarged diameter defining a spring chamber 16. The needle 12 carries a spring abutment 18 located within the spring chamber 16 which engages an end of a spring 20 arranged to bias the valve needle 12 into engagement with its seating. The spring abutment 18 may further damp movement of the needle 12. The end of the spring housing 14 remote from the nozzle body 10 engages a distance piece 22 against which the other end of the spring 20 acts. The distance piece 22 includes an axially extending through bore within which a component 12*a* carried by the spring abutment 18 is slidable. A drain passage 24 is provided in the spring housing 14 to connect the spring chamber 16 to a suitable low pressure drain, thus movement of the needle 12 does not result in the fuel within the spring chamber 16 being pressurized undesirably.

The end of the distance piece 22 remote from the spring housing 14 abuts a valve housing 26 which includes an axially extending through bore 28. The bore 28 communicates with an appropriate low pressure drain through a passage (not shown). A needle control valve member 30 is slidable within the bore 28 and is engageable with a seating defined by part of the bore 28. The needle control valve member 30 is a good fit within the bore 28 thus leakage therebetween is restricted. The lower end of the valve member 30 is provided with a blind drilling 32 which receives an end of a second component 34, the other end of which engages the component 12*a* thus the second component is moveable with the needle 12. Adjacent the blind end of the blind drilling 32, the valve member 30 is provided with radially extending drillings 36 which communicate with an annular chamber 38 defined by a region of the bore 28 of enlarged diameter. A drain passage 40 communicates with the annular chamber 38 through an orifice 42 thus providing a restricted flow to a suitable low pressure drain.

Above the seating, the valve member 30 includes a region of reduced diameter defining, with a region of the bore 28 of reduced diameter, an annular chamber 44 with which a passage 46 communicates, the needle control valve controlling communication between the passage 46 and the chamber defined by the blind drilling 32, the end of the second component 34 adjacent the blind end of the blind drilling 32, the drillings 36 and the chamber 38.

The end of the valve housing 26 remote from the distance piece 22 abuts a stator housing 48 which in turn abuts a pump housing 50; the nozzle body 10, spring housing 14, distance piece 22, valve housing 26, and stator housing 48 being secured to the pump housing 50 by a cap nut 52. An annular chamber 54 is defined between the cap nut 52 and the valve and stator housings 26, 48, the chamber 54 communicating through an opening 56 with a low pressure drain, the drain passage 40 opening into the chamber 54.

The pump housing 50 is provided with a pump chamber 58 within which a plunger 60 is reciprocable under the action of a cam and tappet arrangement (not shown). The chamber communicates with a passage 62 which communicates through passages 64, 66, 68, 70 provided in the spring housing 14, distance piece 22 and valve and stator housings 26, 48 to supply fuel from the pump chamber 58 to the angled, thrust surfaces of the needle 12. The passage 46 provided in the valve housing communicates with the passage 68 thereby supplying fuel from the pump chamber 58 to the annular chamber 44.

A blind drilling 72 is provided in the pump housing 50, and a drain valve member 74 is slidable within the drilling 72. The drain valve member 74 is provided with a region of reduced diameter defining, with the drilling 72, an annular chamber 76 which communicates with the passage 62 through a connecting passage 78. The blind end of the drilling 72 conveniently communicates with a drain volume through an appropriate passage (not shown) provided in the pump housing 50.

The lower end of the drain valve member 74 is of enlarged diameter and is engageable with a seating defined around the open end of the drilling 72 in order to control the flow of fuel between the connecting passage 78 and a chamber 80 provided in the stator housing 48. A disc spring 82 is engaged between the drain valve member 74 and the second valve housing 48 to bias the drain valve member 74 downwardly, away from its seating.

An electromagnetic actuator is located within the stator housing 48. The electromagnetic actuator comprises a first stator component 84 secured within the chamber 80 and a second stator component 86. An electrical winding is associated with the stator components and there is further provided an armature 88. The armature 88 is carried by a rod 90 which is in screw-thread engagement with the upper end of the control valve member 30. A preloaded helical spring 92 guided by the rod 90 acts between the armature 88 and the drain valve member 74. The disc spring 82 biases the armature 88 away from the stator component 84, the biasing force being transmitted through the helical spring 92, and hence the control valve member 30 is biased away from its seating. A shim 94 is provided in order to control the separation of the armature 88 and first stator component 84 when the actuator is energised, and a shim 95 is provided to control the travel of the armature 88 relative to the stator component 84. A shim 96*a* is provided in order to determine the prestressing of the helical spring 92, and a shim 96*b* sets the first stage lift (the movement of the armature necessary to move the drain valve member 74 into engagement with its seating).

The chamber 80 communicates through passages (not shown) with the annular chamber 54 and thus is at relatively low pressure. Similarly, the bore 28 is at low pressure, communicating with a suitable drain as indicated hereinbefore. A passage 100 is provided in the pump housing 50 communicating with the chamber 80 in order to provide a leakage path for leakage fuel from the plunger bore 58 to drain.

In use, starting from the position illustrated in the accompanying drawings, the winding is energised and both the drain valve member 74 and the control valve member 30 are in engagement with their seatings.

As the control valve member is in engagement with its seating, the end of the second component 34 located within the drilling 32 is exposed to relatively low pressure through the orifice 42 and drain passage 40. The plunger 60 is moving inwardly generating an increase in the pressure of the fuel within the chamber 58. The angled, thrust surfaces of the needle 12 are exposed to the high pressure fuel, thus the needle 12 is lifted from its seating and injection is occurring.

To terminate injection, the current applied to the winding is reduced to such an extent that the armature 88 moves under the action of the spring 92 to lift the control valve member 30 from its seating whilst maintaining engagement between the drain valve member 74 and its seating. The movement of the control valve member 30 results in high pressure fuel being applied to the second component 34 assisting the action of the spring 20, the force applied to the second component 34 due to the application of pressurized fuel thereto being equal to that applied to the valve needle 12 due to the application of fuel at the same high pressure acting over substantially the same area. The orifice 42 restricts the flow of fuel to drain, hence maintaining the pressure acting on the second component 34. As the force applied to the second chamber due to the application of pressurized fuel balances that applied to the needle 12, the action of the spring 20 moves the needle 12 into engagement with its seating thus terminating injection whilst the fuel pressure within the pump chamber 58 remains high.

Subsequently, the winding is fully de-energised resulting in the drain valve member 74 moving from its seating under the action of the spring 82. The fuel pressure within the pump chamber 58 then quickly falls as a result of the flow of fuel to drain past the drain valve member 74. Continued inward movement of the plunger 60 causes further fuel to be displaced to drain. It will be appreciated that the de-energisation of the winding may be a single operation rather than two operations as described hereinbefore.

After inward movement of the plunger 60 has been completed, the plunger 60 moves outwardly under the action of a helical spring 98. The outward movement draws fuel into the pump chamber 58 past the drain valve member 74 from the low pressure drain. The plunger 60 subsequently starts to move inwards under the action of the cam and tappet arrangement. The drain valve member 74 occupies a position in which it is spaced from its seating, thus the inward movement of the plunger 60 simply displaces fuel past the drain valve member 74 to drain.

When it is determined that pressurization of the fuel should commence, the winding is energised to a sufficient extent to move the drain valve member 74 into engagement with its seating against the action of the disc spring 82, the movement of the armature 88 being transmitted to the drain valve member 74 through the spring 92 without further compressing the spring 92 at this stage. The movement of the armature 88 at this stage is insufficient to move the control valve member 30 into engagement with its seating. The movement of the drain valve member 74 terminates the displacement of fuel from the pump chamber 58 to drain, thus continued inward movement of the plunger 60 pressurizes the fuel in the pump chamber 58 and passages and chambers of the injector communicating with the pump chamber 58.

As, at this stage, the control valve member 30 is not in engagement with its seating, the chamber defined, in part, by the end of the second component 34 contains fuel at high pressure, the orifice 42 only permitting a restricted flow of fuel to drain thus ensuring that the end of the second component 34 is exposed to high pressure. The action of the high pressure fuel on the second component 34 together with the action of the spring 20 is sufficient to maintain the needle 12 in engagement with its seating against the action of the fuel pressure acting against the angled surfaces of the needle 12. The increase in fuel pressure in the chamber 58 thus does not cause injection.

In order to commence injection, the winding is fully energised resulting in additional movement of the armature 88 and hence the control valve member 30, against the action of the spring 92 resulting in the control valve member 30 engaging its seating. Such movement of the control valve member 30 results in the end of the second component 34 no longer being exposed to high pressure, the orifice 42 permitting the pressure applied to the second component 34 to fall to a sufficient extent such that the action of the high pressure fuel on the angled surfaces of the needle 12 causes the needle 12 to lift from its seating and hence in injection commencing.

Termination of injection is as described hereinbefore. If the injector is to be used in circumstances where one or more pilot injections are followed by a main injection, the injector may be controlled in such a way as to terminate the or each pilot injection whilst maintaining high pressure in the pump chamber 58, and then commence the later, main injection by fully energizing the winding, fully de-energizing the winding to relieve the pressure in the pump chamber 58 after termination of the main injection. There may be circumstances, for example when an associated engine is operating low speed, when it is desirable to relieve the pressure within the pump chamber 58 between the pilot and main injections, and this can be achieved by controlling the injector appropriately.

In order to aid control of movement of the control valve member 30, the dimensions of the control valve member 30 and second component 34 are conveniently such that the control valve member 30 is substantially pressure balanced at all times, i.e. both when the control valve member 30 engages its seating and when it is spaced from its seating. This may be achieved by making the seating diameter equal to diameter A shown in FIG. 2 to ensure that the control valve member 30 is substantially pressure balanced when it engages its seating. In order to ensure that the control valve member 30 is substantially pressure balanced when spaced from its seating, the effective area on which fuel acts tending to move the control valve member 30 away from its seating (area at diameter B minus area at diameter A) should be equal to that acting to move the control valve member 30 into engagement with its seating (area at diameter C). Diameter C is conveniently substantially equal to the guide diameter of the valve needle 12 (as mentioned hereinbefore), but it may be preferable for the diameter C to be larger than the needle guide diameter to achieve faster termination of injection.

It will be appreciated that the 'dead volume' on the drain side of the control valve seating is relatively small, thus the pressure acting on the second component 34 changes quickly in response to movement of the control valve member 30. As both the control valve member 30 and the drain valve member 74 are moved by a single armature 88 under the control of a single winding, it will be appreciated that the injector is of relatively simple construction, only two electrical connections being required to control the operation thereof.

It is envisaged that in an alternative arrangement, the orifice 42 may be omitted, fuel being able to leak from the chamber defined, in part, by the end of the second component 34 to drain at a rate sufficient to control the movement of the valve needle in the manner described hereinbefore through a clearance defined between the member 30 and bore 28, or between the member 30 and component 34.

As indicated hereinbefore, the blind end of the drilling 72 communicates with a low pressure drain, thus allowing movement of the drain valve member 74 without generating a significant pressure increase within the blind end of the drilling 72. In an injector arrangement of the type described hereinbefore, it may be advantageous to damp the movement of the drain valve member 74 more than the subsequent movement of the control valve member 30 as the difference in damping assists in defining the intermediate position at which the armature 88 must stop, in use. One technique for damping movement of the drain valve member 74 is to locate a flow restrictor in the passage which connects the blind end of the drilling 72 to the low pressure drain.

Figure 2:
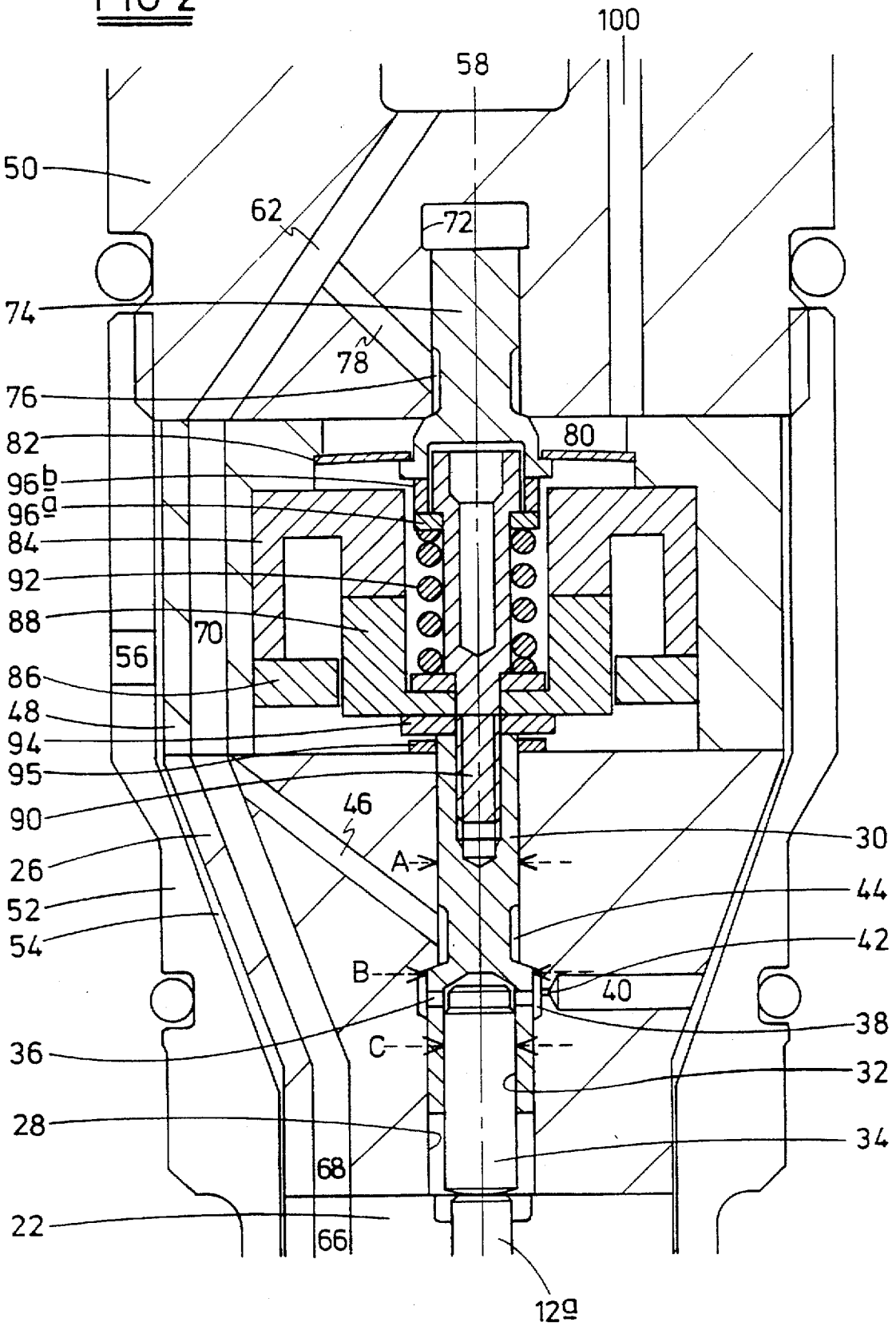
FIG. 2 is an enlarged view of part of FIG. 1.
Figure 3:
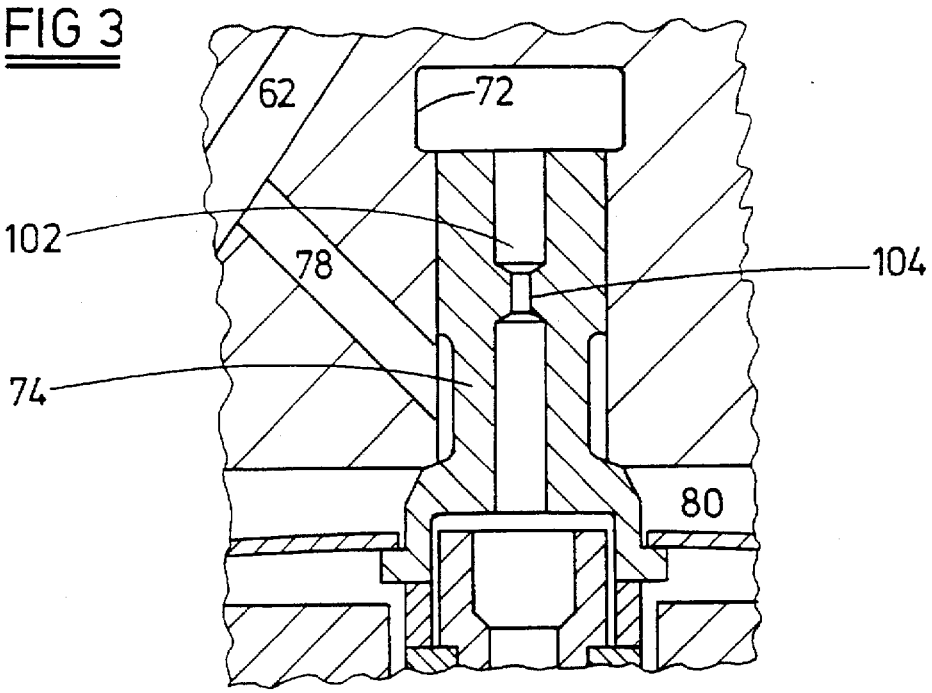
FIGS. 3 and 4 are enlarged sectional views illustrating modifications.

FIG. 3 illustrates an alternative technique for damping movement of the drain valve member 74. In the arrangement of FIG. 3, the blind end of the drilling 72 communicates through a passage 102 which extends along the axis of the drain valve member 74 with the chamber 80 which communicates with the low pressure drain. The passage 102 replaces the passage (not shown) of the arrangement of FIGS. 1 and 2 which interconnects the blind end of the drilling 72 and the low pressure drain. The passage 102 includes a region 104 of reduced diameter which restricts the rate at which fuel can flow through the passage 102. In use, when the drain valve member 74 moves towards its seating, the volume of the chamber defined between the blind end of the drilling 72 and the drain valve member 74 reduces, forcing fuel to flow therefrom, through the passage 102 to the chamber 80. As the rate of fuel flow through the passage 102 is restricted, so is the rate of movement of the drain valve member 74.

As, during the subsequent movement of the control valve member 30, the drain valve member 74 does not move, the presence of the passage 102 and region 104 has no damping effect upon the movement of the control valve member 30.

Figure 4:
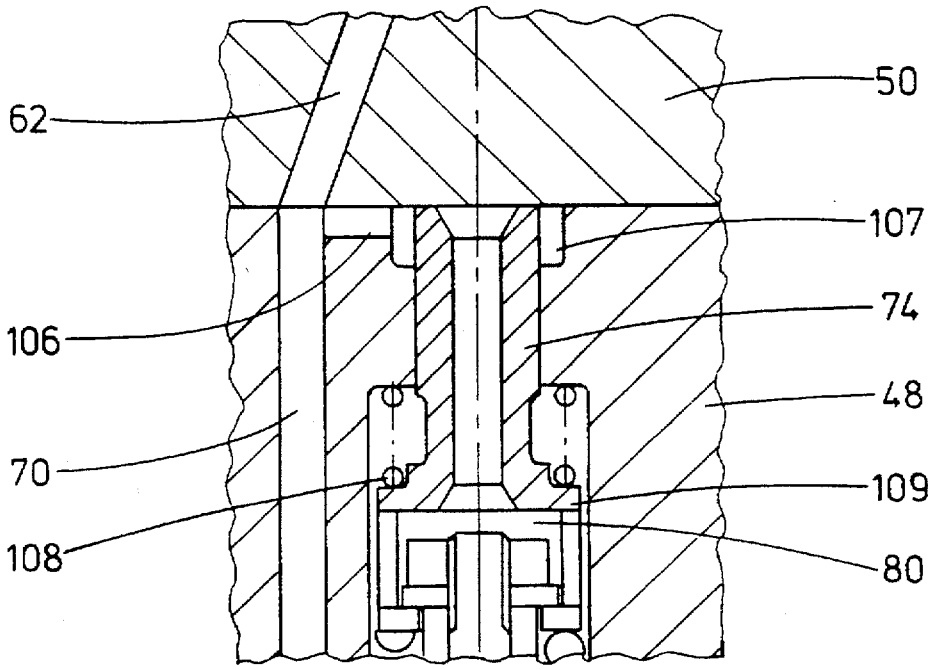

In the arrangements of FIGS. 1 to 3, the passages 62, 78 are formed by drillings which communicate with one another. The provision of two such drillings results in the pump housing 50 being relatively difficult to construct, and also the application of fuel at high pressure, in use, to the connection between the drillings may result in the housing 50 being damaged. FIG. 4 illustrates a modification to the arrangements of FIGS. 1 to 3 in which the drain valve member 74 takes the form of a tubular member slidable within a bore provided in the stator housing 48. The upper end of the drain valve member 74 is engageable with a seating area defined by the lower end face of the pump housing 50.

The pump housing 50 includes a passage 62 which interconnects the pump chamber 58 and the passage 70. The upper end of the stator housing 48 is provided with a groove 106 to provide a flow path between the passages 62, 70 and an enlarged part 107 of the bore of the stator housing 48.

In the position shown in FIG. 4, the actuator is energized, and the drain valve member 74 engages the seating, thus communication between the pump chamber 58 and chamber 80 is broken. Upon full de-energization of the actuator, the drain valve member 74 moves under the action of a spring 108 to lift the drain valve member 74 from its seating permitting fuel flow between the pump chamber 58 and chamber 80.

The drain valve member 74 includes a flange 109 which may be designed to restrict fuel flow to/from a chamber within which the spring 108 is located, thus damping movement of the drain valve member 74.

Figure 5:
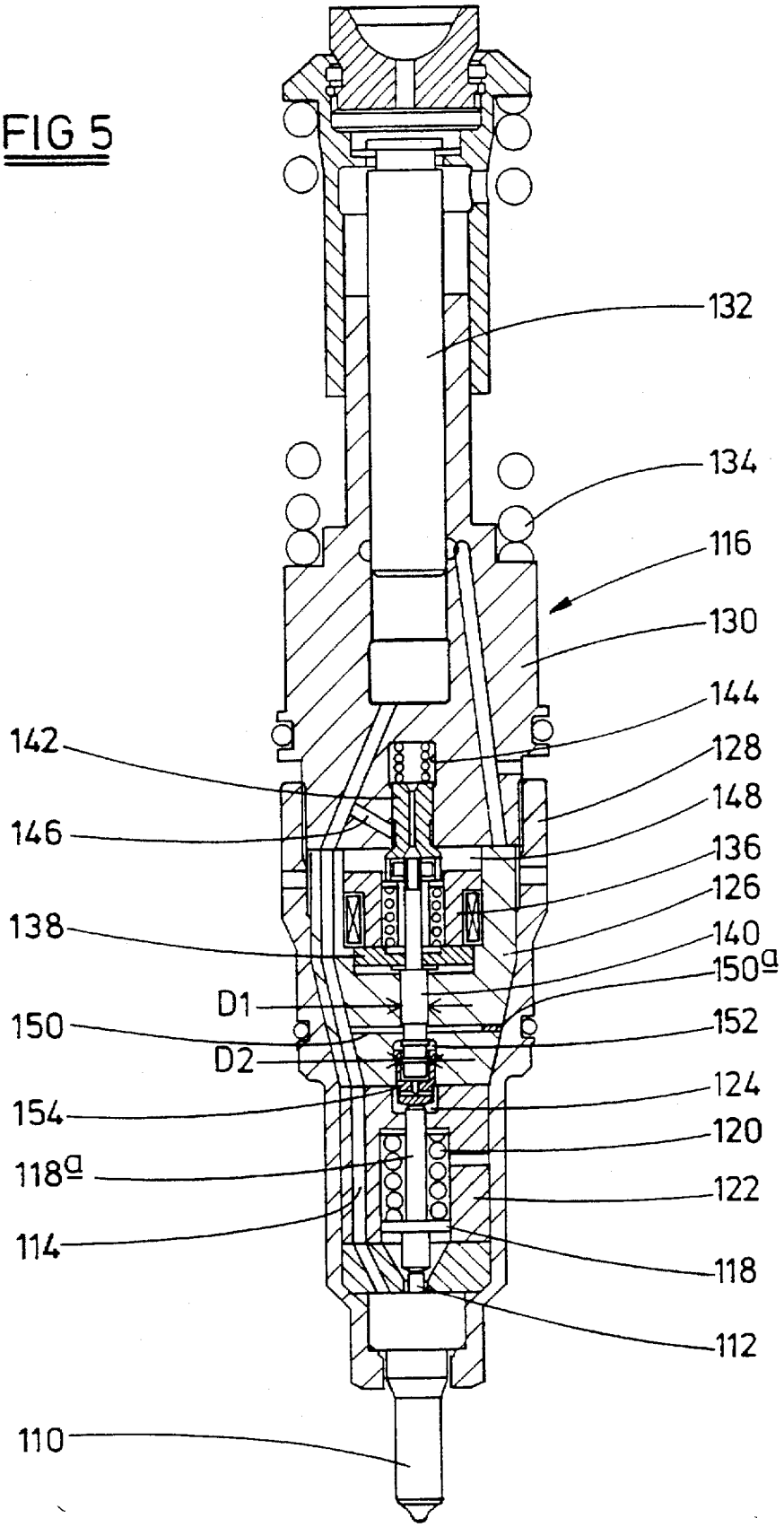
FIG. 5 is a sectional view of an alternative embodiment.

FIG. 5 illustrates a pump injector in accordance with another embodiment of the invention which comprises a nozzle body 110 within which a valve needle 112 is slidable. The valve needle 112 includes thrust surfaces (not shown) to which fuel is supplied through a supply line 114 from a pump unit 116.

The end of the valve needle 112 abuts a spring abutment 118 which is located within a spring chamber defined by a drilling of relatively large diameter provided within a distance piece 122. A spring 120 engages the spring abutment 118 and biases the valve needle 112 towards a position in which it engages an associated seating (not shown). The spring abutment 118 includes an extension 118*a* which extends completely through the spring chamber, extending into a chamber 124 defined between the distance piece 122 and a valve housing 126, the chamber 124 communicating through a passage (not shown) with a low pressure drain. As illustrated, the nozzle body 110, distance piece 122 and valve housing 126 are secured to the pump unit 116 by a cap nut 128.

The pump unit 116 comprises a pump body 130 within which a bore is provided, a plunger 132 being reciprocable within the bore under the influence of a cam arrangement (not shown), the plunger 132 being biased out of the bore by a spring 134. The supply line 114 communicates with the inner end of the bore.

The valve housing 126 houses the stator arrangement 136 of an electromagnetic actuator, the stator arrangement 136 being arranged to influence the position of an armature 138 which is rigidly secured to a control valve member 140 slidable within a bore provided in the valve housing 126. The armature 138 further influences the position of a drain valve member 142 which is slidable within a bore 144 formed in the end of the pump housing 130. The drain valve member 142 is engageable with, but spring biased away from a seating defined around an end of the bore 144 to control communication between a passage 146 which communicates with the supply line 114 and a chamber 148 defined between the valve housing 126 and pump housing 130, the chamber 148 communicating with a low pressure drain. A resilient connection is provided between the armature 138 and the drain valve member 142 whereby further movement of the armature 138 is permitted once the drain valve member 142 has moved into engagement with its seating.

The control valve member 140 is engageable with a seating in order to control communication between a passage 150 which communicates with the supply line 114 and a control chamber 152. One end of the passage 150 is closed by a plug 150*a*. The control chamber 152 is defined, in part, by part of the bore within which the control valve member 140 is slidable, and by an abutment member 154 which is slidable within a part of the bore of enlarged diameter and which abuts an end of the component 118*a*. The abutment member 154 includes a drilling within which an end of the control valve member 140 is received, a small clearance existing between the control valve member 140 and abutment member 154 thus a restricted flow of fuel is permitted from the control chamber 152 to the interior of the drilling provided in the abutment member 154. The drilling of the abutment member 154 communicates through drillings with the chamber 124.

The diameter, and hence the cross-sectional area, of the valve member 140 located upstream of the seating (indicated at D1 in FIG. 5) is equal to that of the part of the valve member 140 located within the drilling of the abutment member 154 (indicated at D2 in FIG. 5). As the seating is defined by a part of the bore, the seating line defines a circle of diameter substantially equal to the bore diameter, which is substantially equal to D1. When the valve member 140 engages the seating, the areas of the valve member 140 exposed to high pressure fuel are therefore substantially equal thus the valve member 140 is substantially pressure balanced. When the valve member 140 is lifted from its seating, the control chamber 152 is exposed to high pressure fuel. The upper surface of the part of the valve member 140 located within the drilling of the abutment member 154 is therefore exposed to high pressure fuel. As the diameter of this part of the valve member 140 is substantially equal to that upstream of the seating, the valve member 140 is also substantially pressure balanced in this position.

The cross-sectional area of the part of the abutment member 154 which is exposed to the pressure within the control chamber 152 is conveniently substantially equal to the cross-sectional area of the valve needle 112 which is exposed to the pressure of fuel supplied through the supply line 114 to urge the valve needle 112 away from its seating. In order to ensure that the valve will operate correctly, it is important to ensure that when the valve member 140 engages its seating, high pressure fuel can be applied over a sufficiently large area of the needle to lift the needle from its seating against the action of the spring, and when the valve member 140 is lifted from its seating, the maximum force resulting from the application of high pressure fuel to the exposed part of the abutment member 154, together with the spring force, is greater than the maximum force arising from the application of high pressure fuel to the injector needle.

In use, in the position illustrated in FIG. 5, the plunger 132 is in its fully withdrawn position, and the bore is charged with fuel at relatively low pressure. The stator arrangement 136 is not energised, thus the armature 138 is spaced therefrom due to the action of a spring located within the stator arrangement 136. In this position of the armature 138, the control valve member 140 is spaced from its seating, and the drain valve member 142 is spaced from its seating. As the drain valve member 142 is spaced from its seating, inward movement of the plunger 132 results in fuel from the bore being displaced through the supply line 114 and passage 146, past the drain valve member 142 to the chamber 148 and from there to the low pressure drain. As the control valve member 140 is spaced from its seating, the fuel pressure within the control chamber 152 is substantially equal to that within the supply line 114. The action of the fuel pressure within the control chamber 152 upon the abutment member 154 together with the action of the spring 120 is sufficient to maintain the valve needle 112 in engagement with its seating against the action of the fuel pressure acting upon the thrust surfaces of the valve needle 112. Injection therefore does not occur. Subsequent inward movement of the plunger 132 continues to displace fuel to the low pressure drain.

A predetermined time before injection is due to commence, the stator arrangement 136 is energised to a first level resulting in movement of the armature 138 towards the stator arrangement 136, and in movement of the control valve member 140 and drain valve member 142. The movement is sufficient to bring the drain valve member 142 into engagement with its seating, but the movement is insufficient to bring the control valve member 140 into engagement with its seating. It will be appreciated, therefore, that the communication between the supply line 114 and the chamber 148 is broken, but that the fuel pressure within the control chamber 152 will be maintained at substantially the same pressure as that within the supply line 114. Continued inward movement of the plunger 132 results in the fuel pressure within the bore and within the supply line 114 increasing, the fuel no longer being displaced to the low pressure drain, and as the control chamber 152 is maintained at substantially the same pressure as that within the supply line 114, injection does not commence.

In order to commence injection, the stator arrangement 136 is energised to a second, higher level causing further movement of the control valve member 140. The resilient connection between the armature 138 and drain valve member 142 permits such additional movement of the armature 138 and control valve member 140 even though the drain valve member 142 is in engagement with its seating. The additional movement of the control valve member 140 results in the control valve member 140 engaging its seating, and hence in the control chamber 152 no longer communicating with the supply line 114. The small clearance between the control valve member 140 and abutment member 154 and the drillings in the abutment member 154 allow fuel to flow from the control chamber 152 to the chamber 124 and from there to the low pressure drain. It will be appreciated that, in the absence of fuel supply, the pressure within the control chamber 152 falls. The reduction in pressure within the control chamber 152 results in a reduction in the force applied to the valve needle 112 by the abutment member 154, and a point will be reached beyond which the force due to the pressure within the control chamber 152 and due to the spring 120 is insufficient to maintain the valve needle 112 in engagement with its seating against the action of the fuel applied to the thrust surfaces of the valve needle 112. The valve needle 112 is then lifted from its seating and fuel flows past the valve needle 112 to outlet apertures provided in the end of the nozzle body 110.

In order to terminate injection, the stator arrangement 136 is returned to its first energised state, the armature 138 moving away from the stator arrangement 136 under the action of the spring to lift the control valve member 140 from its seating and hence raise the pressure within the control chamber 152 to substantially that within the supply line 114.

The increased pressure within the control chamber 152 results in an increased force being applied to the valve needle 112 urging the valve needle 112 towards its seating. Such an increased force is sufficient to move the valve needle 112 into engagement with its seating, hence injection is terminated. Once injection has been terminated, if desired, injection may be recommenced by energising the stator arrangement 136 to its second level once more. Such re-energisation is useful where the injector is to be used in a fuel system where a pilot injection and a subsequent main injection are to be supplied to each of the cylinders of an associated engine.

When injection is terminated, the stator arrangement 136 is fully de-energised, and the associated movement of the armature 138 permits movement of the drain valve member 142 away from its seating, such movement permitting fuel to be displaced past the drain valve member 142 to the chamber 148. The pressure within the supply line 114 and bore of the pump unit 116 falls. Continued inward movement of the plunger 132 results in fuel being displaced past the drain valve member 142 as described hereinbefore. Such displacement of fuel continues until the plunger 132 occupies its innermost position whereafter it is withdrawn from the bore under the action of the spring 134. Movement of the plunger 132 out of the bore results in fuel being drawn from the low pressure drain to the supply line 114 and bore. Such movement of fuel into the bore continues until the plunger 132 occupies its outermost position which is shown in FIG. 5. From this position, the plunger commences inward movement, and the pumping cycle as described hereinbefore is repeated.

It will be appreciated that the control valve arrangement of this embodiment is relatively simple as the control valve member 140 only requires one diameter and one seating to be concentric with one another to a high accuracy. Further, although the bore, within which the control valve member 140 and abutment member 154 are slidable, includes regions of various diameters, the concentricity of the various diameters is less important as a clearance is required between the control valve member 140 and abutment member 154 in order to permit fuel flow therebetween at a restricted rate. The control valve arrangement is therefore relatively simple to manufacture.

Although the description hereinbefore is of the use of the control valve in pump/injector arrangements, it will be appreciated that the control valve is suitable for use in other applications, for example in an arrangement in which the pump unit is spaced from the injector, a pipe being used to supply fuel displaced by the pump to the injector.

Figure 6:
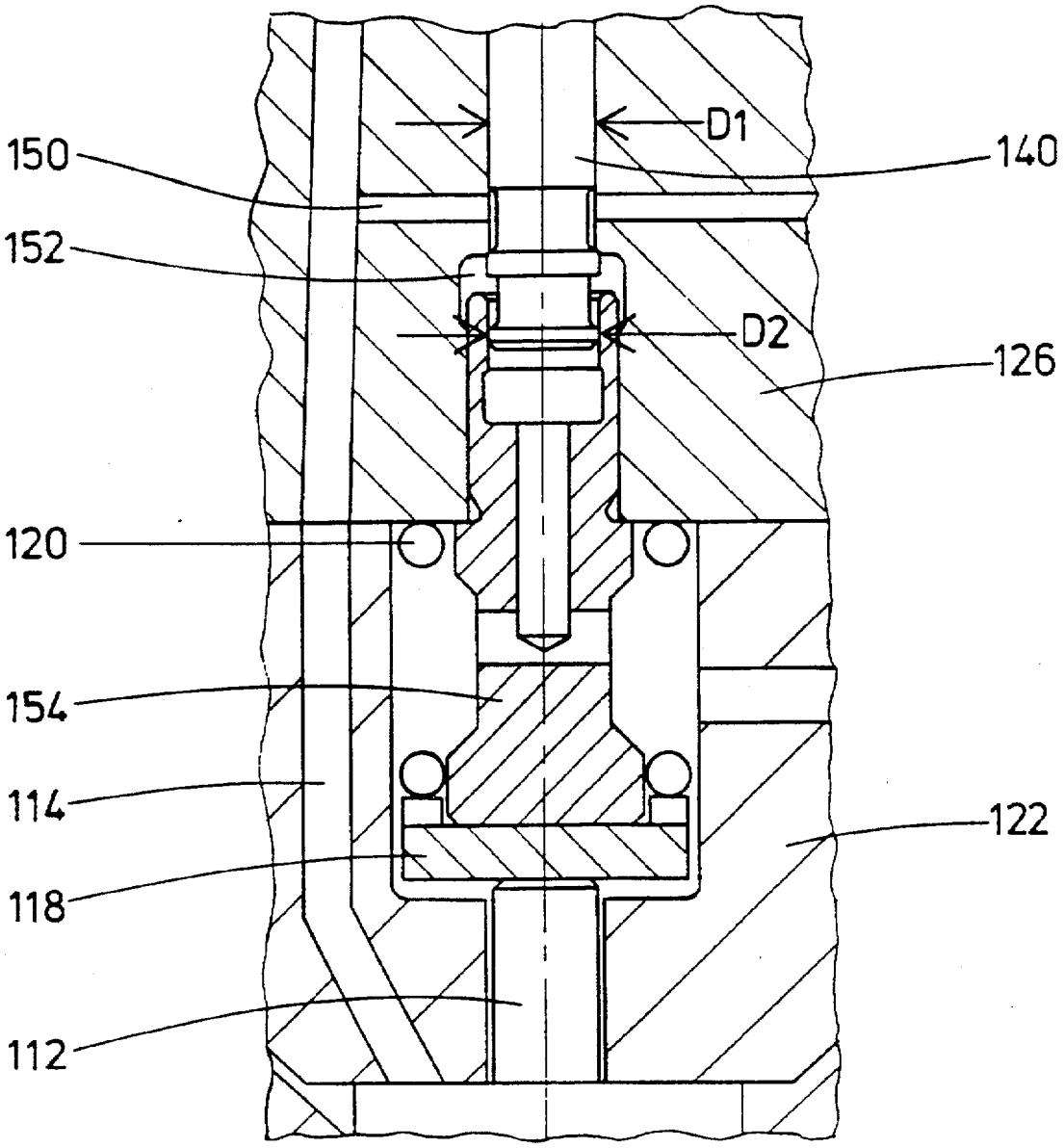
FIG. 6 is an enlarged sectional view illustrating a modification to the embodiment of FIG. 5.

FIG. 6 illustrates a modification to the arrangement shown in FIG. 5. In the FIG. 6 modification, the bore of the distance piece 122 is of stepped form and includes a large diameter region defining a spring chamber within which the spring 120 is located. The spring 120 is engaged between the lower end face of the valve housing 126 and the spring abutment 118. The extension 118*a* of the FIG. 5 arrangement is omitted, and instead the abutment member 154 is of increased length and engages the spring abutment 118. Operation of this embodiment is as described with reference to FIG. 5.

We claim:

1. An injector comprising a body, a valve needle slidable within the body and biassed into engagement with a seating by a spring, a fuel supply line for supplying fuel to thrust surfaces provided on the valve needle to apply a force on the valve needle acting against the action of the spring, a drain valve operable to control communication between the supply line and a low pressure drain, a needle control valve controlling the fuel pressure within a control chamber defined, in part, by a surface of the valve needle or a component carried thereby oriented such that when high pressure fuel is applied to the control chamber, a force is applied to the valve needle in a direction assisting the spring, wherein the drain valve and the needle control valve are controlled by an electromagnetic actuator arrangement including a single armature, the needle control valve and the surface of the valve needle or component carried thereby defining part of the control chamber being of dimensions such that the needle control valve is substantially pressure balanced at all times.

2. An injector as claimed in claim 1, wherein the needle control valve controls communication between the control chamber and the supply line.

3. An injector as claimed in claim 2, wherein the control chamber communicates through a restricted flow path with a low pressure drain.

4. An injector as claimed in claim 3, wherein the restricted flow path comprises a passage of small diameter provided in a housing defining, in part, the control chamber.

5. An injector as claimed in claim 3, wherein the restricted flow path comprises a clearance between part of the needle control valve and a bore within which the part of the needle control valve is received.

6. An injector as claimed in claim 5, wherein the bore is provided in an abutment member which includes the said surface defining part of the control chamber, the bore communicating with a low pressure drain.

7. An injector as claimed in claim 1, further comprising damping means for damping movement of the drain valve.

8. An injector as claimed in claim 7, wherein the drain valve comprises a drain valve member engageable with a seating, movement of the drain valve member relative to the seating adjusting the volume of a chamber, the damping means comprising a restricted fuel flow path between the chamber and a low pressure drain.

9. An injector as claimed in claim 1, wherein the area of said surface defining part of the control chamber is substantially equal to the effective area of the thrust surfaces of the valve needle when the needle is lifted from its seating.

10. An injector as claimed in claim 1, wherein the area of said surface defining part of the control chamber is substantially equal to the effective area of the thrust surfaces of the valve needle when the needle engages its seating.

11. An injector as claimed in claim 1, wherein the area of said surface defining part of the control chamber is greater than the effective area of the thrust surfaces of the valve needle when the needle is lifted from its seating.

12. An injector as claimed in claim 1, wherein the area of said surface defining part of the control chamber is greater than the effective area of the thrust surfaces of the valve needle when the needle engages its seating.

13. An injector comprising a body, a valve needle slidable within the body and biassed into engagement with a seating by a spring, a fuel supply line for supplying fuel to thrust surfaces provided on the valve needle to apply a force on the valve needle acting against the action of the spring, a drain valve operable to control communication between the supply line and a low pressure drain, a needle control valve controlling the fuel pressure within a control chamber defined, in part, by a surface of the valve needle or a component carried thereby oriented such that when high pressure fuel is applied to the control chamber, a force is applied to the valve needle in a direction assisting the spring, wherein the drain valve and the needle control valve are controlled by an electromagnetic actuator arrangement including a single armature, the area of the surface of the valve needle or component carried thereby defining part of the control chamber being substantially equal to the area of the thrust surfaces when the needle is lifted from its seating.

14. An injector comprising a body, a valve needle slidable within the body and biassed into engagement with a seating by a spring, a fuel supply line for supplying fuel to thrust surfaces provided on the valve needle to apply a force on the valve needle acting against the action of the spring, a drain valve operable to control communication between the supply line and a low pressure drain, a needle control valve controlling the fuel pressure within a control chamber defined, in part, by a surface of the valve needle or a component carried thereby oriented such that when high pressure fuel is applied to the control chamber, a force is applied to the valve needle in a direction assisting the spring, wherein the drain valve and the needle control valve are controlled by an electromagnetic actuator arrangement including a single armature, the area of the surface of the valve needle or component carried thereby defining part of the control chamber being substantially equal to the area of the thrust surfaces when the needle engages its seating.

15. An injector comprising a body, a valve needle slidable within the body and biassed into engagement with a seating by a spring, a fuel supply line for supplying fuel to thrust surfaces provided on the valve needle to apply a force on the valve needle acting against the action of the spring, a drain valve operable to control communication between the supply line and a low pressure drain, a needle control valve controlling the fuel pressure within a control chamber defined, in part, by a surface of the valve needle or a component carried thereby oriented such that when high pressure fuel is applied to the control chamber, a force is applied to the valve needle in a direction assisting the spring, wherein the drain valve and the needle control valve are controlled by an electromagnetic actuator arrangement including a single armature, the area of the surface of the valve needle or component carried thereby defining part of the control chamber being greater than the area of the thrust surfaces when the needle is lifted from its seating.

16. An injector comprising a body, a valve needle slidable within the body and biassed into engagement with a seating by a spring, a fuel supply line for supplying fuel to thrust surfaces provided on the valve needle to apply a force on the valve needle acting against the action of the spring, a drain valve operable to control communication between the supply line and a low pressure drain, a needle control valve controlling the fuel pressure within a control chamber defined, in part, by a surface of the valve needle or a component carried thereby oriented such that when high pressure fuel is applied to the control chamber, a force is applied to the valve needle in a direction assisting the spring, wherein the drain valve and the needle control valve are controlled by an electromagnetic actuator arrangement including a single armature, the area of the surface of the valve needle or component carried thereby defining part of the control chamber being greater than the area of the thrust surfaces when the needle engages its seating.

17. An injector comprising a body, a valve needle slidable within the body and biased into engagement with a seating by a spring, a fuel supply line for supplying fuel to thrust surfaces provided on the valve needle to apply a force to the valve needle opposing that applied by the spring, a drain valve controlling communication between the supply line and a low pressure drain, a needle control valve controlling the timing commencement and termination of fuel injection, and an actuator including a single armature controlling operation of the drain and needle control valves, wherein movement of the armature to a first position occurs against the action of first spring means, such movement closing the drain valve, movement of the armature to a second position occurring against the action of the second spring means only, such movement closing the needle control valve.

18. An injector as claimed in claim 17, wherein the armature is located between the drain valve and the needle control valve.

19. An injector as claimed in claim 17, wherein the first and second spring means are arranged in series.

* * * * *

UNITED STATES PATENT AND TRADEMARK OFFICE

CERTIFICATE OF CORRECTION

PATENT NO. : 5,893,516

DATED : April 13, 1999

INVENTOR(S) : Anthony T. Harcombe et al

It is certified that error appears in the above-indentified patent and that said Letters Patent is hereby corrected as shown below:

On the title page item,

[73] Assignee:

After "England" add --and Caterpillar Inc, Peoria, Illinois.

Signed and Sealed this

Fourteenth Day of September, 1999

*Attest:*

Q. TODD DICKINSON

*Attesting Officer*

*Acting Commissioner of Patents and Trademarks*